US007973718B2

(12) United States Patent
Mak et al.

(10) Patent No.: US 7,973,718 B2
(45) Date of Patent: Jul. 5, 2011

(54) SYSTEMS AND METHODS EMPLOYING COUPLING ELEMENTS TO INCREASE ANTENNA ISOLATION

(75) Inventors: Angus C. K. Mak, Shatin (CN); Corbett R. Rowell, Mongkok (CN); Chi-Lun Mak, Ma On Shan (CN)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 105 days.

(21) Appl. No.: 12/200,899

(22) Filed: Aug. 28, 2008

(65) Prior Publication Data

US 2010/0053022 A1 Mar. 4, 2010

(51) Int. Cl.
*H01Q 1/38* (2006.01)

(52) U.S. Cl. ..... 343/700 MS

(58) Field of Classification Search ..... 343/700 MS, 343/702, 833, 834
See application file for complete search history.

(56) References Cited

U.S. PATENT DOCUMENTS

| | | | | |
|---|---|---|---|---|
| 4,358,770 | A | 11/1982 | Satoh et al. | |
| 4,412,223 | A | 10/1983 | Kautz | |
| 5,952,983 | A | 9/1999 | Dearnley et al. | |
| 6,225,950 | B1 | 5/2001 | Johansson et al. | |
| 6,392,600 | B1 | 5/2002 | Carson et al. | |
| 6,891,506 | B2 * | 5/2005 | Jarmuszewski et al. | 343/702 |
| 6,906,676 | B2 | 6/2005 | Killen et al. | |
| 6,943,746 | B2 | 9/2005 | Talvitie et al. | |
| 7,589,680 | B2 * | 9/2009 | Tsai et al. | 343/702 |
| 2003/0119457 | A1 | 6/2003 | Standke | |
| 2004/0095286 | A1 | 5/2004 | Lee et al. | |
| 2005/0040992 | A1 | 2/2005 | Chirila | |
| 2006/0139216 | A1 | 6/2006 | Glocker et al. | |
| 2008/0018548 | A1 | 1/2008 | Maeda | |
| 2008/0284666 | A1 * | 11/2008 | Hilgers | 343/735 |

FOREIGN PATENT DOCUMENTS

| | | | |
|---|---|---|---|
| EP | 1722486 | A1 | 11/2006 |
| JP | 2000-216628 | A | 8/2000 |
| JP | 2008-017047 | A | 1/2008 |
| JP | 2008-124595 | A | 5/2008 |

OTHER PUBLICATIONS

International Search Report and Written Opinion for PCT/CN2008/072335 dated Jun. 11, 2009.

Kyeong-Sik Min et al., "Improved MIMO Antenna by Mutual Coupling Suppression between Elements," The European Conference on Wireless Technology 2005, Oct. 3-4, 2005, pp. 125-128.

"MIMO Antenna Research," Hong Kong Applied Science and Technology Research Institute Co., Ltd. internal presentation, Dec. 13, 2006, 10 pp.

"USB Dongle Antennas Dual Band 2×2," Hong Kong Applied Science and Technology Research Institute Co., Ltd. internal presentation, Dec. 13, 2006, 8 pp.

* cited by examiner

*Primary Examiner* — Hoang V Nguyen
(74) *Attorney, Agent, or Firm* — Fulbright & Jaworksi L.L.P.

(57) ABSTRACT

An antenna system comprises a first antenna element mutually coupled with a second antenna element, the mutual coupling between the first and second antenna elements causing a first current in the second antenna element, and a coupling element disposed at least partially between the first and second antenna elements, wherein the coupling element is mutually coupled to each of the first and second antenna elements, and wherein the coupling element is configured to induce a second current in the second antenna element that at least partially cancels the first current.

22 Claims, 8 Drawing Sheets

SYSTEMS AND METHODS EMPLOYING COUPLING ELEMENTS TO INCREASE ANTENNA ISOLATION

TECHNICAL FIELD

The present description is directed, generally, to multiple-element antennas and, more specifically, to systems and methods employing components to reduce the effects of mutual coupling between and among multiple antenna elements.

BACKGROUND

As antenna systems grow smaller, space between antenna elements in those systems becomes more scarce. Not only does the spacing between antenna elements have the potential to affect the radiation pattern of a system, but it can also affect the amount of mutual coupling between antenna elements. Mutual coupling is inductive/capacitive coupling between two or more antennas, and it can sometimes result in unwanted performance degradation by interfering with signals being transmitted or by causing an antenna element to radiate unwanted signals. Generally, the closer the placement of two antenna elements, the higher the potential for mutual coupling.

Accordingly, modern antenna designers generally look for ways to decrease coupling (i.e., increase isolation) between some antenna elements. This is especially true for multi-channel systems, as the signals on one channel should usually and ideally be unaffected by the signals on other channels. It is also particularly true for Multiple Input Multiple Output (MIMO) antenna systems which require several antennas to operate at the same frequency but work independently of each other.

Some antenna systems employ antenna elements placed above a ground plane. In such systems, the antenna elements can induce currents in the ground plane that travel to other antenna elements and increase undesired coupling. To decrease the coupling, various techniques have been devised. For example, one solution has been to split the ground plane so that two antennas that might interfere are not connected by a continuous ground plane. However, such systems generally produce an inadequate amount of isolation.

Other proposed systems include intricate fabrication processes to produce structures with cells shorted to the ground through vias in a Printed Circuit Board (PCB). Such structures are analogous to Photonic Band Gap (PBG, used in optics) structures and generally act as bandstop filters and can be designed to cancel specific, unwanted signals. However, such systems are expensive in terms of both space and money because of the complexity of the three-dimensional shapes of the structures. Currently, no prior art system provides adequate isolation with a minimum of complexity.

BRIEF SUMMARY

Various embodiments of the invention are directed to systems and methods that include a coupling element in a multiple-element antenna system. In one example, a coupling element is placed between two antenna elements. The shape of the coupling element is designed so that it cancels out the current that is due to direct coupling of the elements. In some embodiments, the coupling element can be quite small, thereby offering economy of space. Furthermore, various embodiments are much less complex than PBG-inspired designs and, thus, are cheaper to manufacture than prior art systems that use PBG-inspired isolation elements.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
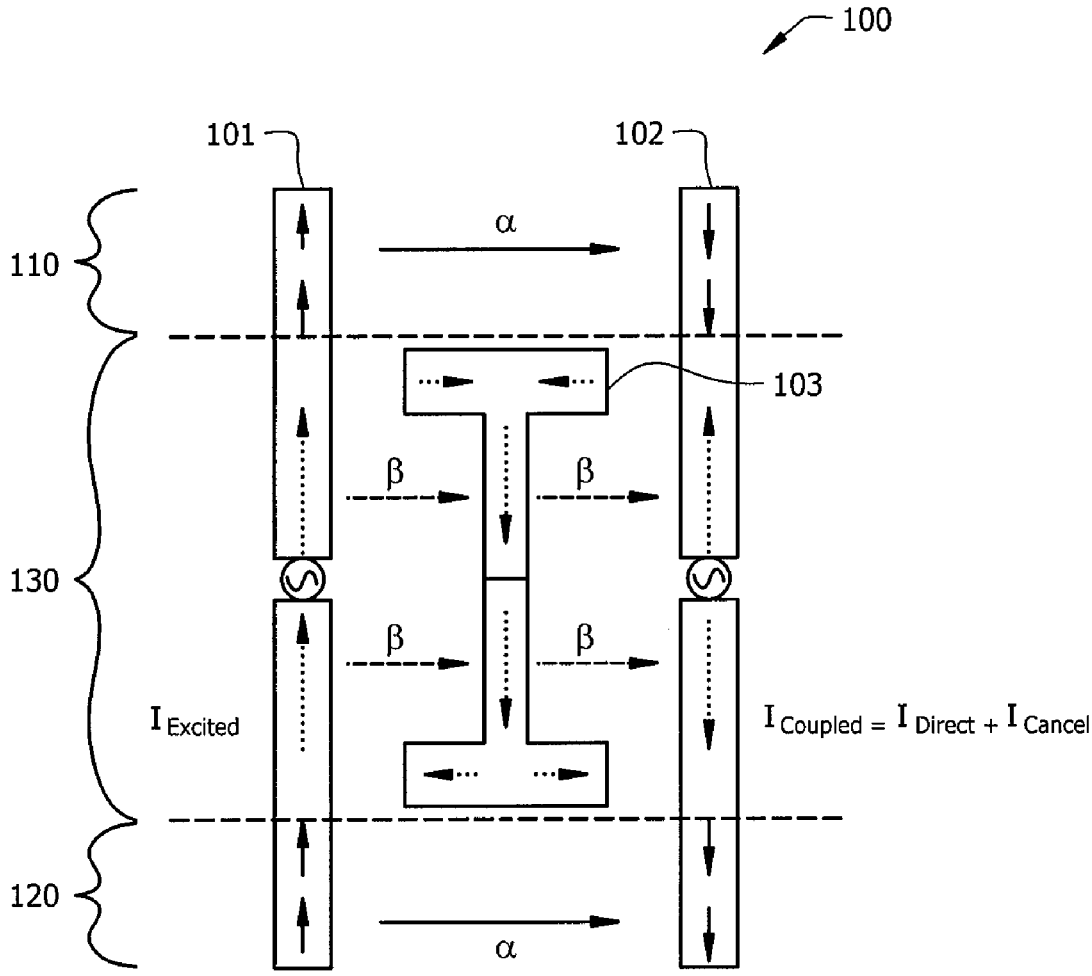
FIG. 1 is an illustration of an exemplary antenna system, adapted according to one embodiment of the invention.

FIG. 1 is an illustration of exemplary antenna system 100, adapted according to one embodiment of the invention. System 100 includes antenna elements 101 and 102, as well as coupling element 103. In this example, antenna element 101 is driven by a Radio Frequency (RF) feed, and the current in antenna element 101 is $I_{Excited}$. The total current in antenna element 102 that is due to mutual coupling with antenna element 101 is $I_{Coupled}$.

There are three regions of interest in FIG. 1. Region 110 is where coupling element 103 does not lie between antenna elements 101 and 102. In other words, in region 110, each antenna element 101 and 102 is in the other's line of sight. Region 120 is similar to region 110. In region 130, coupling element 103 is positioned between antenna elements 101 and 102.

In regions 110 and 120, there is direct coupling between antenna elements 101 and 102. The current due to direct coupling is referred to in this example as $I_{Direct}$, and it is equal to $\alpha$ $I_{Excited}$, wherein $\alpha$ is a constant that is affected by distance between antenna elements 101 and 102 as well as by the sizes of regions 110 and 120. $I_{Direct}$ is in a direction opposite (i.e., 180° out of phase) that of $I_{Excited}$. In region 130, the coupling between antenna elements 101 and 102 is not direct. Instead, in region 130, antenna elements 101 and 102 each couple with coupling element 103, rather than with each other. Antenna element 101 couples with coupling element 103, thereby inducing a current in coupling element 103 that is in the opposite direction of $I_{Direct}$. The current that is induced in coupling element 103 then induces a current ($I_{Cancel}$) in antenna element 103 that is shifted by approximately 180 degrees again. The phase of $I_{Cancel}$ is in a direction opposite that of $I_{Direct}$ and $I_{Cancel}$ can be expressed as $\beta$ $I_{Excited}$, where $\beta$ is a constant that depends on the distances between antenna elements 101 and 102 and coupling element 103 as well as on the size of coupling element 103. In this example, $\beta$ is approximately equal to $\alpha$, so that $I_{Coupled}=I_{Direct}+I_{Cancel}\sim$zero.

In the present example, antenna elements 101 and 102 are shown as dipole elements, which are generally $\lambda/2$ in length. The total length of coupling element 103, including both the vertical and horizontal components, is also $\lambda/2$ as well. The constant $\beta$ is affected by the length of the vertical portion (i.e., parallel to antenna elements 101 and 102) of coupling element 103. The horizontal portion (i.e., perpendicular to antenna elements 101 and 102) of coupling element 103 has very little, if any, effect on $\beta$. Instead, the horizontal portion is present so that the total length of coupling element 103 is $\lambda/2$.

While the example above refers to horizontal and vertical portions, such terms are used for ease of illustration only. More generally, it can be said that the portion of a coupling element (e.g., 103) that is mutually coupled with its proximate antenna elements (e.g., 101 and 102) affects $\beta$, whereas the portion that is not mutually coupled with the proximate antenna elements is used to ensure that the total length is a resonant length.

Figure 2:
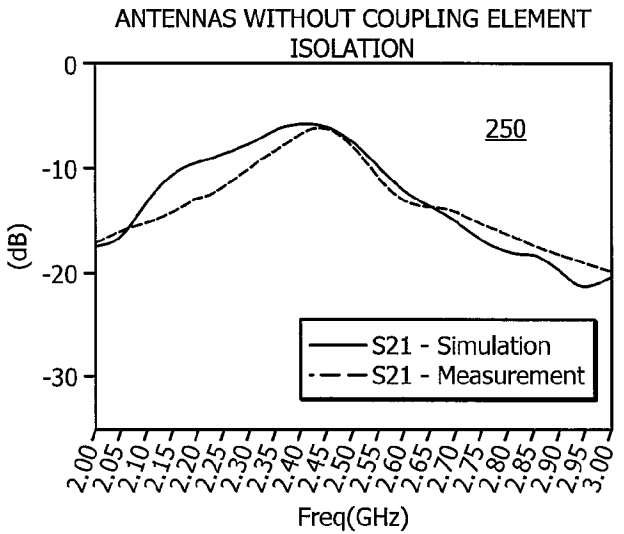
FIG. 2 is an illustration of an exemplary antenna system, adapted according to one embodiment of the invention.
Figure 2:
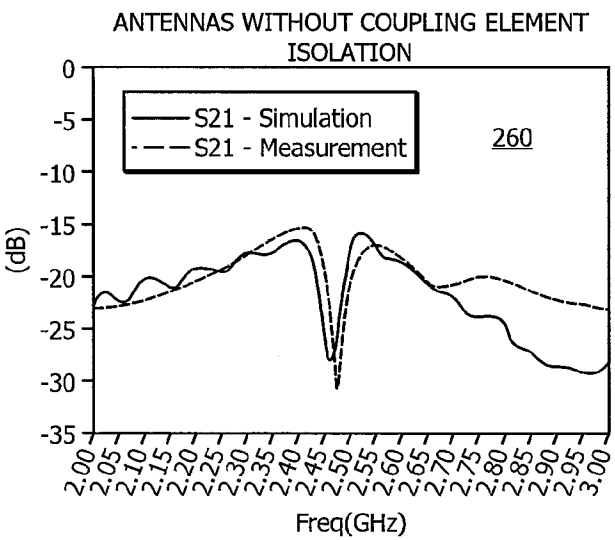
Figure 2:
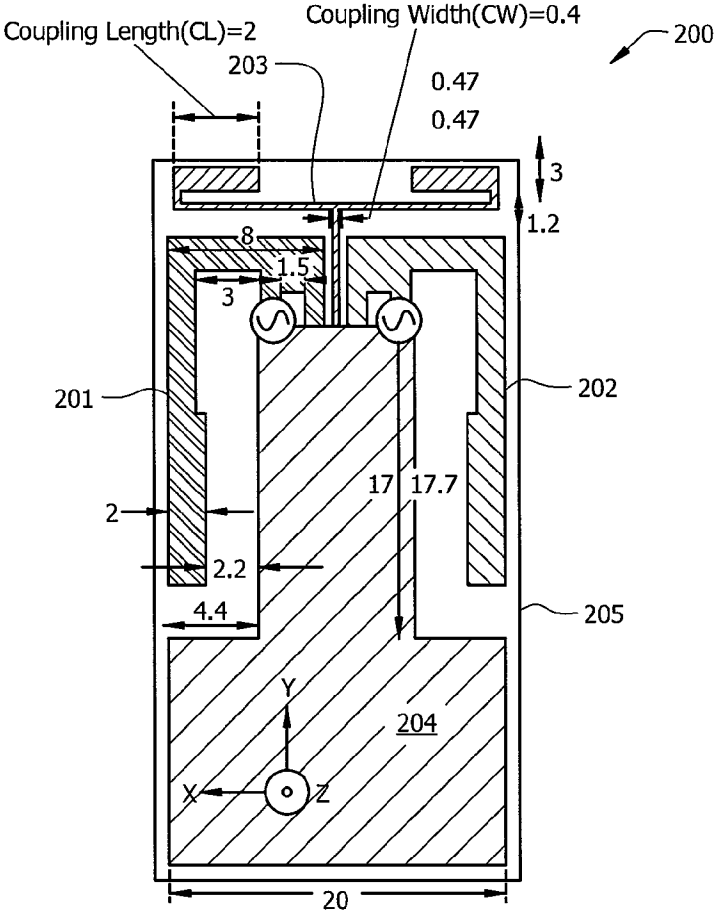

FIG. 2 is an illustration of exemplary antenna system 200, adapted according to one embodiment of the invention. FIG. 2 shows an antenna system design with dimensions (in mm) thereon and also provides graphs 250 and 260 to explain the performance of antenna system 200.

Antenna system 200 is built on Printed Circuit Board (PCB) 205, and it includes antenna elements 201 and 202, coupling element 203, and ground plane 204. As is apparent from FIG. 2, antenna elements 201 and 202 are Planar Inverted F Antenna (PIFA) elements. Due to their proximity to each other, antenna elements 201 and 202 experience mutual coupling. Coupling element 203 reduces or eliminates the effects of mutual coupling, thereby improving the performance of antenna system 200.

While the example of FIG. 1 shows a coupling element of total length $\lambda/2$, not all embodiments are so limited. In embodiments that use antenna elements of a resonant length $\lambda/4$, the total length of the coupling element is also $\lambda/4$. Examples of antenna elements that have resonant lengths of $\lambda/4$ include, e.g., monopoles and PIFAs. In the case of antenna system 200, which uses PIFAs as antenna elements 201 and 202, coupling element 203 has a length of $\lambda/4$.

Graph 250 shows the simulated and measured performance of an antenna system similar to that of antenna system 200, but without coupling element 203. By contrast, graph 260 shows simulation and measurement results for system 200. In graph 250 at 2.45 GHz there is −8 dB of coupling. Graph 260 shows −30 dB of coupling at 2.45 GHz, indicating an improvement of over −20 dB of isolation. The improvement is impressive, considering that −30 dB means that for every one thousand units of energy only one unit is coupling. For real world systems, it is very difficult to achieve zero coupling; however, embodiments of the invention can improve isolation such that the effects of coupling is near zero (as in graph 260). In many systems, reducing the effects of mutual coupling by as much as −20 dB can bring the effects of coupling down to a level where it has a negligible effect on the performance of the system.

FIG. 2 shows that the coupling length (i.e., not the total length) of coupling element 203 is two millimeters. In designing an antenna system the coupling length can be adjusted to tune the performance of the system by affecting $\beta$. In fact, differing lengths can be simulated and/or tested to arrive at an optimal length.

While dimensions are given in FIG. 2, the invention is not so limited. Any of a variety of designs and structures can be used, and each system can be adapted to perform in specific bands and employ different dimensions. In fact, any dimensions given in this description are illustrative and exemplary but not limiting.

System 200 has directional diversity, in that antenna elements 201 and 202 radiate in different directions. Because of the diversity in antenna system 200, antenna system 200 can be adapted for use in MIMO applications. Coupling element 203 between antenna elements 201 and 202 enhances the performance of antenna system 200 by reducing the effects of coupling between the diverse resonating elements.

Figure 3:
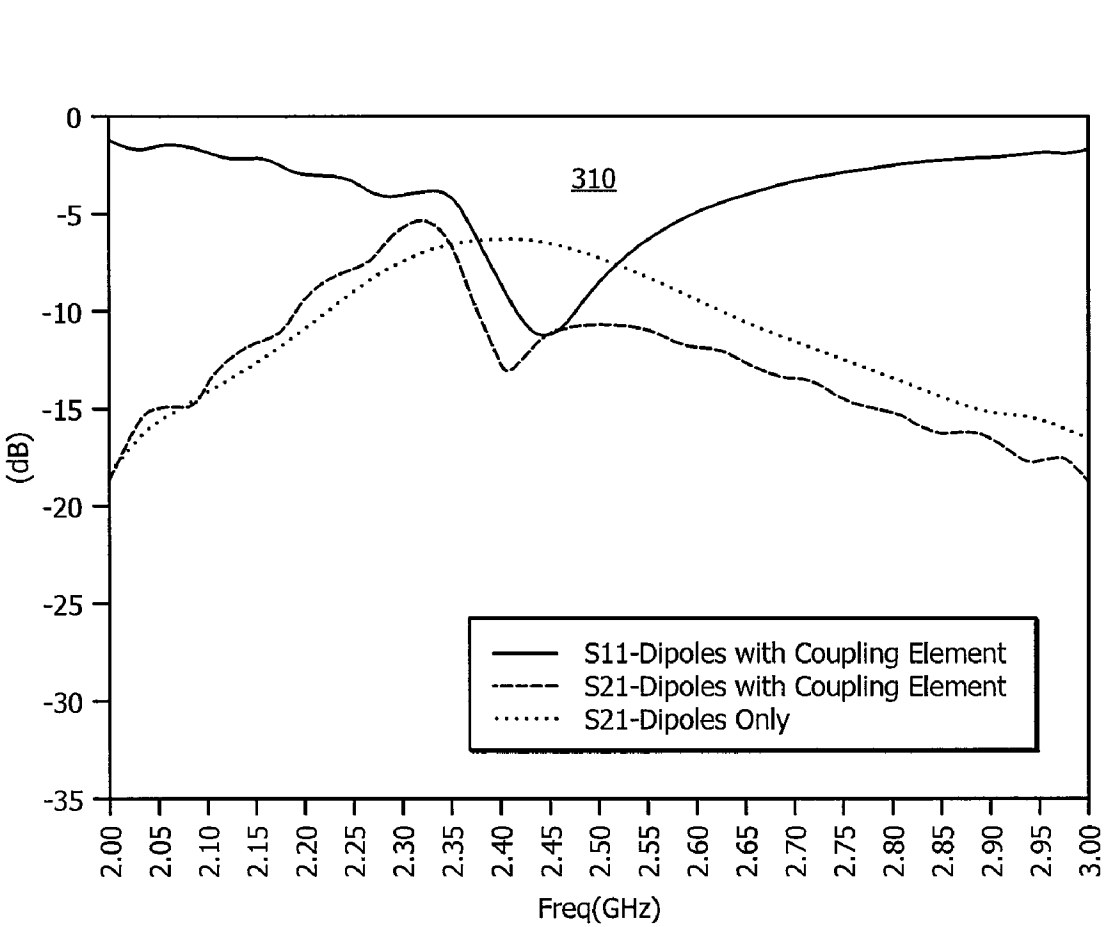
FIG. 3 is an illustration of an exemplary system, adapted according to one embodiment of the invention.
Figure 3:
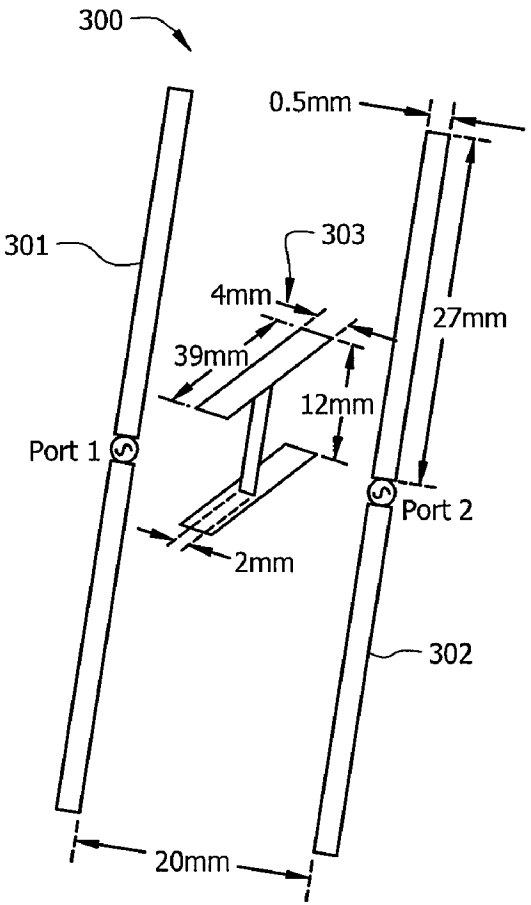

FIG. 3 is an illustration of exemplary system 300, adapted according to one embodiment of the invention. Various embodiments of the invention include Three-Dimensional (3D) structures, such as the embodiment shown as system 300.

System 300 includes dipole antenna elements 301 and 302 and coupling element 303. Antenna system 300 is deigned for performance in the band around 2.4 GHz. Graph 310 shows simulation results for antenna system 300 with and without coupling element 303. As can be seen, the presence of coupling element 303 increases isolation around the resonant frequency of system 300.

Figure 4:
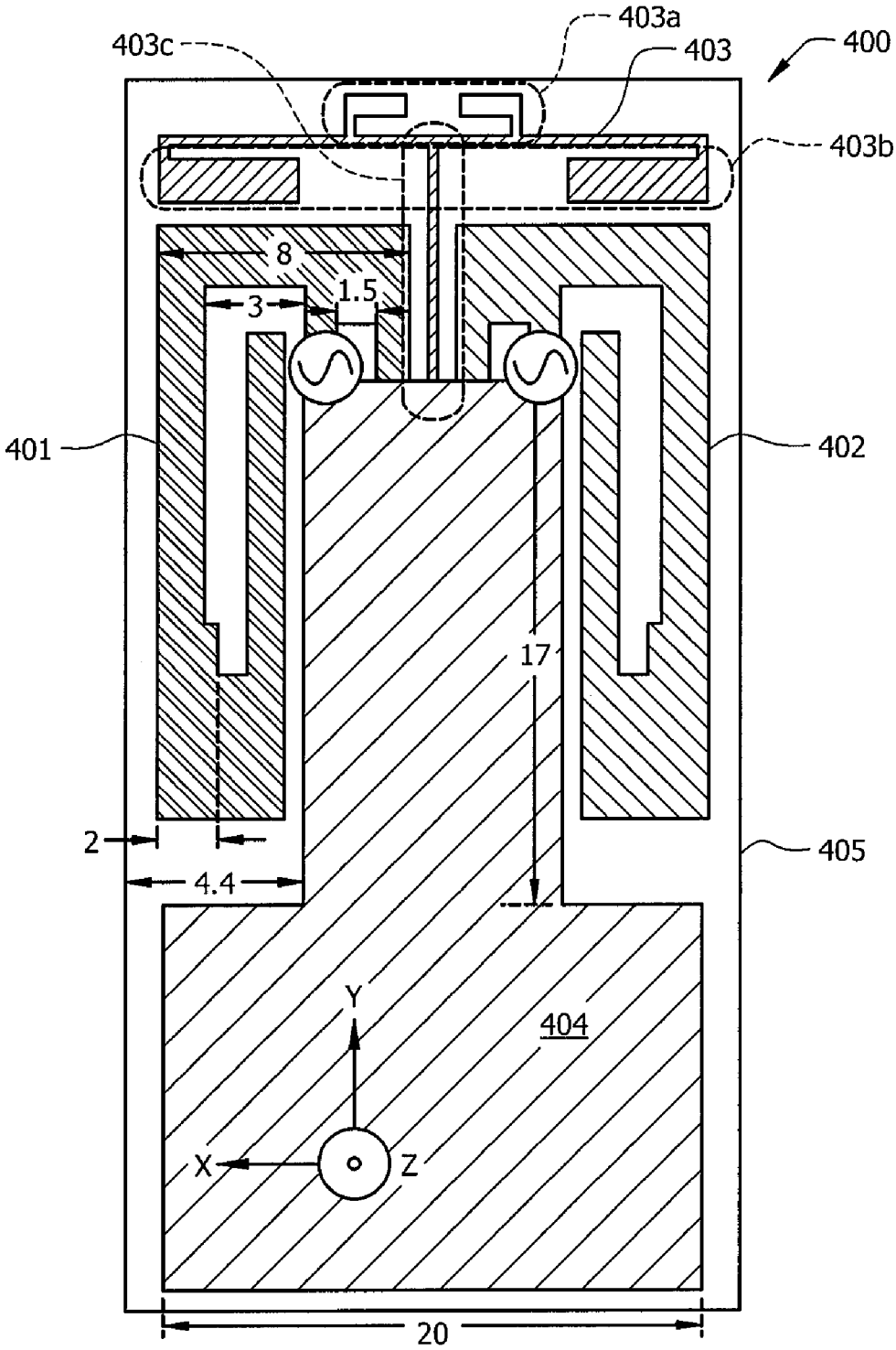
FIG. 4 is an illustration of an exemplary system, adapted according to one embodiment of the invention.

Some embodiments can be applied to multi-band applications. FIG. 4 is an illustration of exemplary system 400, adapted according to one embodiment of the invention. System 400 is a MIMO antenna that provides performance at 2.4 GHz and 5 GHz. System 400 is built on PCB 405 and includes PIFA elements 401 and 402, coupling element 403, and ground plane 404. Coupling element 403 includes two coupling portions: The portion including 403*a* and 403*c* and the portion including 403*b* and 403*c*. Each coupling portion 403*a* plus 403*c* and 403*b* plus 403*c* has a different coupling length (i.e., a different $\beta$) as well as a different effective total length, thereby giving each coupling portion 403*a* plus 403*c* and 403*b* plus 403*c* a different operating band. In this example, coupling element 403 provides isolation to antenna system 400 at 2.4 GHz and 5 GHz.

Figure 7:
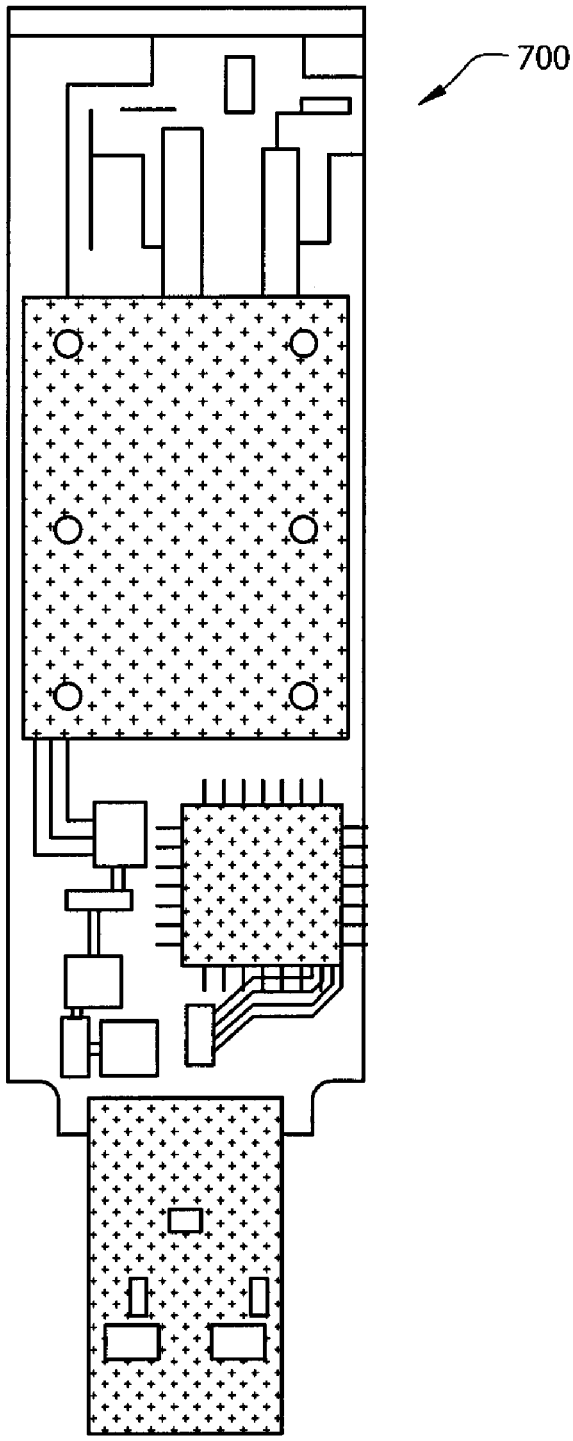
FIG. 7 is an illustration of an exemplary USB dongle, adapted according to one embodiment of the invention.

The embodiment of system 400 can be built on a form factor that is roughly the size of a flash "memory stick" and included in a Universal Serial Bus (USB) dongle, such as exemplary dongle 700 of FIG. 7. In fact, system 400 can be connected to a computer through a USB interface to provide wireless Local Area Network (LAN) connectivity.

Figure 5:
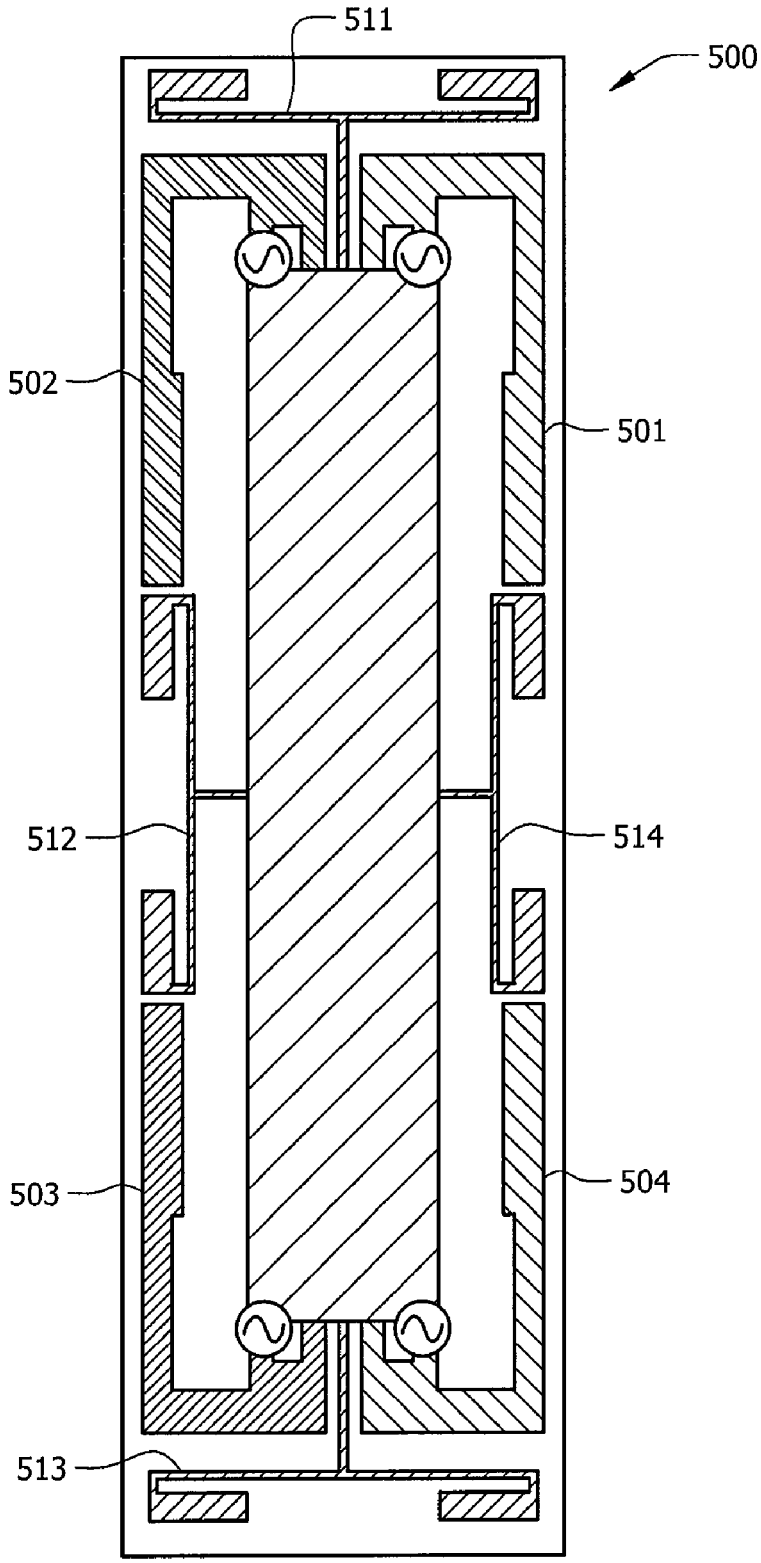
FIG. 5 is an illustration of an exemplary system adapted according to one embodiment of the invention.

Numbers of antenna elements and coupling elements can be scaled for use in particular applications. FIG. 5 is an illustration of exemplary system 500 adapted according to one embodiment of the invention. System 500 includes antenna elements 501-504 and coupling elements 511-514. Coupling element 511 provides isolation between antenna elements 501 and 502; similarly, coupling element 513 provides isolation between antenna elements 503 and 504. Coupling elements 512 and 514 provide isolation between antenna elements 502 and 503, as well as 501 and 504, respectively.

Figure 6:
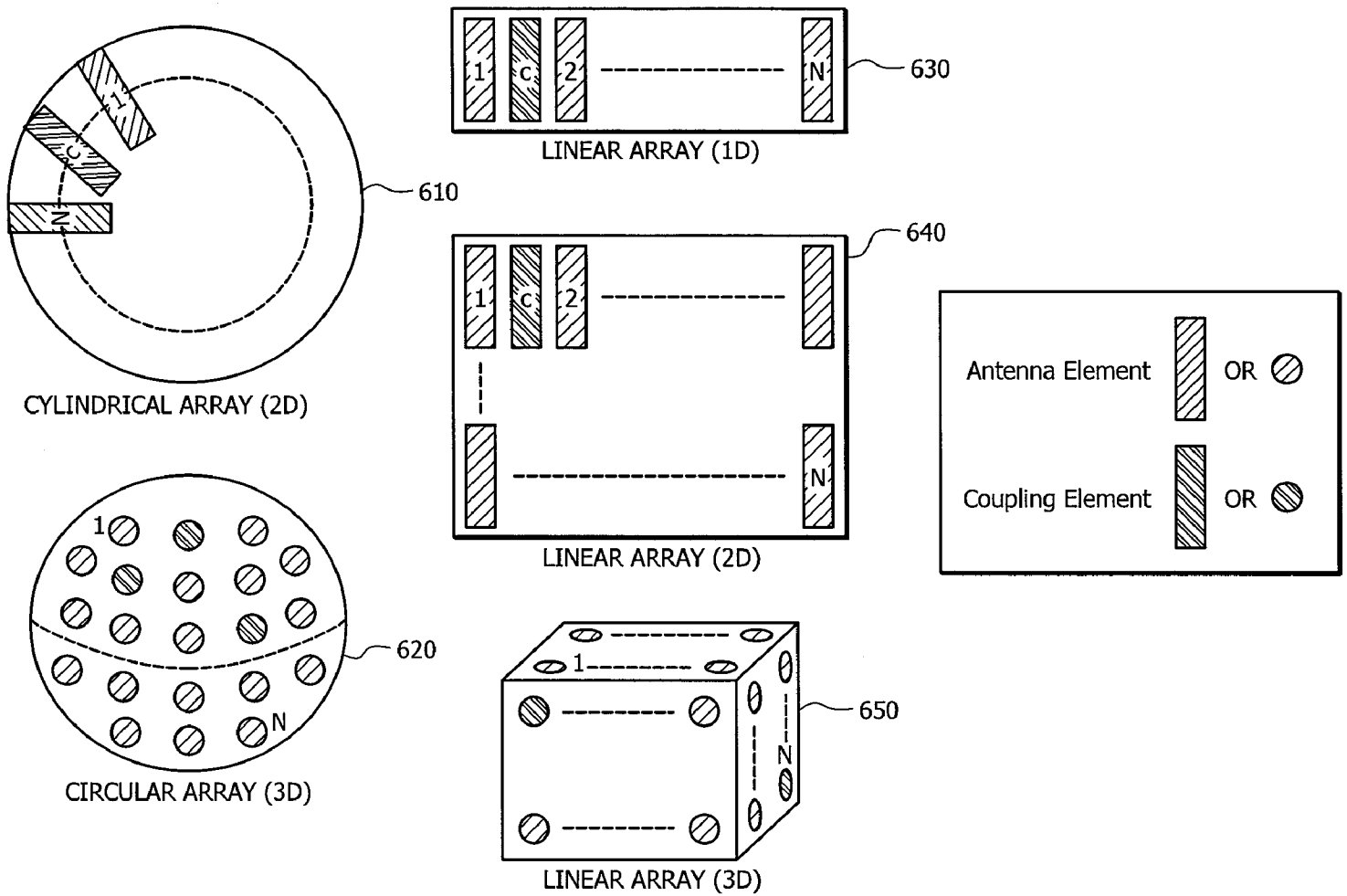
FIG. 6 shows exemplary antenna arrays, adapted according to embodiments of the invention.

Embodiments of the invention can be adapted for use in any of a variety of antenna systems. For example, embodiments can be adapted for use in systems employ dipoles, monopoles, PIFAs, and any other kind of grounded or ungrounded antenna element. Furthermore, various embodiments can be adapted for use in many different arrays, such as 2D, 2.5D, and 3D arrays. FIG. 6 shows exemplary antenna arrays 610, 620, 630, 640, and 650, adapted according to embodiments of the invention. Coupling elements, such as those shown above in FIGS. 1-5, can be used to increase isolation between antenna elements in the arrays of FIG. 6.

Figure 8:
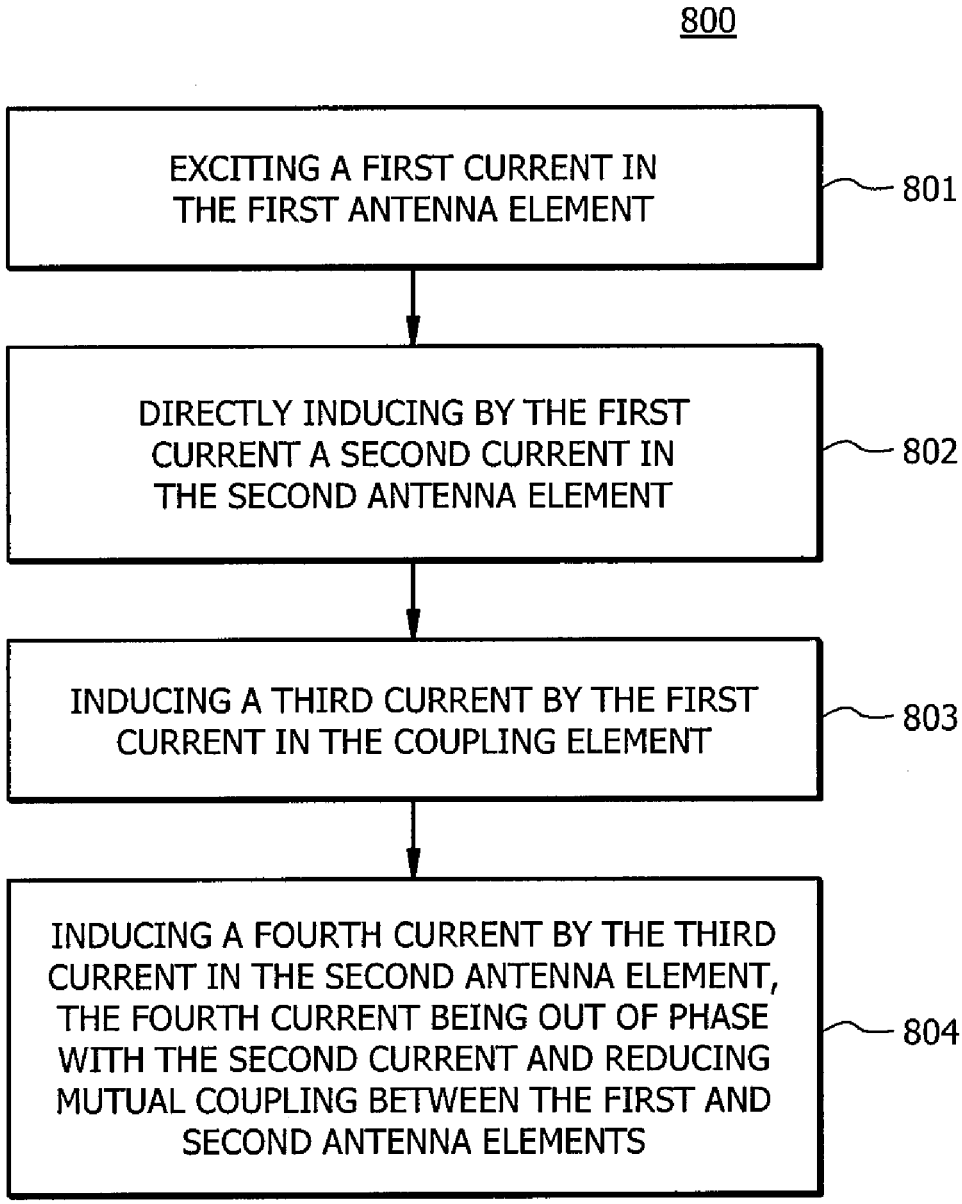
FIG. 8 is an illustration of an exemplary method adapted according to one embodiment of the invention.

Various embodiments of the invention include techniques using coupling elements to increase isolation. FIG. 8 is an illustration of exemplary method 800 adapted according to one embodiment of the invention. Method 800 can be performed on embodiments, such as those described above in FIGS. 1-7.

In action 801, a first current is excited in the first antenna element. In one example, the first antenna element is driven by a Radio Frequency (RF) module. The current can be in any RF band, including bands used in WiFi (IEEE 802.11) applications, cellular telephone applications, and other RF applications that are too numerous to list herein.

In action 802, the first current directly induces a second current in the second antenna element. An example of the first current directly inducing a second current is explained above with respect to FIG. 1, wherein $I_{Excited}$ induces $I_{Direct}$.

In action 803, a third current is induced by the first current in the coupling element. In action 804, a fourth current is induced by the third current in the second antenna element. The fourth current is out of phase with the second current and reduces the effects of the mutual coupling between the first and second antenna elements by at least partially cancelling the second current.

While method 800 is shown as a series of discrete steps, various embodiments of the invention are not so limited. Some embodiments may add, modify, rearrange, and/or omit one or more actions. For instance, from a human's perspective, it will appear that actions 801-804 occur simultaneously and continuously during operation of the antenna system. Furthermore, other methods may include such features as canceling the effects of mutual coupling in two or more operating bands, canceling the effects of mutual coupling between more than one pair of antenna elements, and the like.

Various embodiments of the invention provide advantages over prior art solutions. For example, PBG-inspired solutions are complex, expensive, and large. By contrast, coupling elements, such as those shown above, are relatively simple structures when compared to PBG-inspired solutions. Furthermore, when implemented with metal on a PCB, coupling elements often add little or no additional manufacturing cost for a given antenna system.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna system comprising:

a first antenna element;

a second antenna element, wherein electromagnetic coupling occurs between the first antenna element and the second antenna element such that a current $I_{Excite}$ in the first element causes a current $I_{Direct}$ in the second antenna element; and a coupling element disposed between the first and second antenna elements and mutually coupled to the first and second antenna elements such that the coupling element causes a current $I_{Cancel}$, wherein $I_{Cancel}$ at least partially cancels $I_{Direct}$ by at least −10 dB, wherein a total coupled current in the second antenna element is $I_{Couple}$, wherein $I_{Couple}$ is equal to $I_{Direct}$ plus $I_{Cancel}$ and is negligible.

2. The antenna system of claim 1 wherein $I_{couple}$ is approximately zero.

3. The antenna system of claim 1 wherein said coupling element comprises a portion parallel to said first and second antenna elements and a portion perpendicular to said first and second antenna elements.

4. The antenna system of claim 3 wherein said parallel portion is sized to create $I_{cancel}$.

5. The antenna system of claim 3 wherein said first and second antenna elements comprise dipole elements, and wherein a total length of said perpendicular portion and said parallel portion is $\lambda/2$.

6. The antenna system of claim 3 wherein said first and second antenna elements comprise Planar Inverted F Antenna (PIFA) elements, and wherein a total length of said perpendicular portion and said parallel portion is $\lambda/4$.

7. The antenna system of claim 1 wherein said antenna system provides performance in a plurality of unique frequency bands and wherein said coupling element provides isolation in said plurality of unique frequency bands.

8. A method for increasing isolation in an antenna system, wherein the antenna system comprises a first antenna element, a second antenna element, and coupling element, said method comprising:

exciting a first current in said first antenna element;

directly inducing by said first current a second current in said second antenna element;

inducing a third current by said first current in said coupling element; and inducing a fourth current by said third current in said second antenna element, said fourth current being out of phase with said second current and reducing effects of mutual coupling between said first and second antenna elements.

9. The method of claim 8 wherein said mutual coupling between said first and second antenna elements is reduced to being negligible in the antenna system.

10. The method of claim 8 wherein said mutual coupling between said first and second antenna elements is reduced by at least −10 dB.

11. The method of claim 10 wherein said mutual coupling between said first and second antenna elements is reduced by at least −20 dB.

12. An antenna system comprising:

a first antenna element mutually coupled with a second antenna element, said mutual coupling between said first and second antenna elements causing a first current in said second antenna element; and a coupling element disposed at least partially between said first and second antenna elements, said coupling element mutually coupled to each of said first and second antenna elements;

said coupling element configured to induce a second current in said second antenna element that at least partially cancels said first current, wherein said antenna system comprises a Three-Dimensional (3D) array.

13. The antenna system of claim 12 wherein said first and second antenna elements comprise Planar Inverted F Antenna (PIFA) elements.

14. The antenna system of claim 12 wherein said first and second antenna elements provide two or more unique band of operation, and wherein said coupling element provides isolation in said two or more unique bands of operation.

15. The antenna system of claim 12 wherein said antenna system is included in a Universal Serial Bus (USB) dongle.

16. The antenna system of claim 15 wherein said antenna system provides wireless Local Area Network (LAN) connectivity.

17. An antenna system comprising:

a first antenna element mutually coupled with a second antenna element, said mutual coupling between said first and second antenna elements causing a first current in said second antenna element, wherein said first and second antenna elements comprise Planar Inverted F Antenna (PIFA) elements; and a coupling element disposed at least partially between said first and second antenna elements, said coupling element mutually coupled to each of said first and second antenna elements;

said coupling element configured to induce a second current in said second antenna element that at least partially cancels said first current.

18. The antenna system of claim 17 wherein said antenna system comprises a Two-Dimensional (2D) array.

19. The antenna system of claim 17 wherein said antenna system comprises a Three-Dimensional (3D) array.

20. The antenna system of claim 17 wherein said first and second antenna elements provide two or more unique band of operation, and wherein said coupling element provides isolation in said two or more unique bands of operation.

21. The antenna system of claim 17 wherein said antenna system is included in a Universal Serial Bus (USB) dongle.

22. The antenna system of claim 21 wherein said antenna system provides wireless Local Area Network (LAN) connectivity.

* * * * *